US005850823A

United States Patent [19]

Kasahara

[11] Patent Number: 5,850,823

[45] Date of Patent: Dec. 22, 1998

[54] BLOWBY GAS RETURNING STRUCTURE FOR ENGINE

[75] Inventor: Satoshi Kasahara, Shizuoka-ken, Japan

[73] Assignee: Suzuki Motor Corporation, Shizuoka, Japan

[21] Appl. No.: 934,502

[22] Filed: Sep. 19, 1997

[30] Foreign Application Priority Data

Nov. 29, 1996 [JP] Japan ..... 8-334842

[51] Int. Cl.[6] ..... F02F 7/00

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 2,818,052 | 12/1957 | Trainer | 123/572 |
| 4,686,946 | 8/1987 | Umeda et al. | 123/572 |
| 5,069,192 | 12/1991 | Matsumoto et al. | 123/572 |
| 5,664,549 | 9/1997 | Hutchins | 123/572 |
| 5,690,084 | 11/1997 | Gunji et al. | 123/572 |

FOREIGN PATENT DOCUMENTS

| | | |
|---|---|---|
| 63-61515 | 4/1988 | Japan . |
| 2-53512 | 4/1990 | Japan . |
| 2-96059 | 7/1990 | Japan . |

*Primary Examiner*—Margnenti McMahon
*Attorney, Agent, or Firm*—Flynn, Thiel, Boutell & Tanis, P.C.

[57] ABSTRACT

A blowby gas-returning structure for an engine which is adapted to provide smooth returning of a blowby gas, and to provide a light-weight or compact engine. The blowby gas-returning structure is provided with passage-forming object or wall in order to continue blowby gas passages without interruption. Further, the cylinder block may be provided with void space sections which share space with the blowby gas passages and the cylinder head-mounting bolt holes. In addition, the blowby gas passage in the cylinder head may be disposed offset substantially midway along the length thereof.

11 Claims, 18 Drawing Sheets

BLOWBY GAS RETURNING STRUCTURE FOR ENGINE

FIELD OF THE INVENTION

This invention relates to a blowby gas-returning structure for an engine and, more particularly, to a blowby gas-returning structure for an engine which provides smooth returning of a blowby gas.

BACKGROUND OF THE INVENTION

In engines, blowby gas occurs, which leaks into the crankcase from the combustion chamber between the piston and cylinder sleeve. Major components of the blowby gas are unburned gases which contain a large quantity of hydrocarbons (HC), and need to be returned into the combustion chamber for the purpose of re-combustion therein. To this end, there is provided a blowby gas-returning system in which a commonly used process is to actuate a flow rate-adjusting valve (PCV valve) using the intake pipe pressure of an intake system as a loaded state of the engine, thereby admitting the blowby gas into an air cleaner or an intake passage or otherwise both of them. The admitted gas is thereby returned into the intake air, and is again introduced into the combustion chamber for combustion therein.

A known blowby gas-returning structure is illustrated in FIGS. 11 to 13. In FIGS. 11 and 12, reference numeral 202 denotes an engine; 204 a cylinder block; 206 a cylinder head; 208 a crank shaft; 210 a connecting rod; 212 a piston; 214 a cam shaft; 216 a combustion chamber; 218 an intake port; 220 an exhaust port; 222 a crankcase; 224 an oil pan; 226 a cylinder head cover; 228 an intake manifold; 230 an intake passage; 232 a throttle valve; 234 an exhaust manifold; and 236 an air cleaner.

The cylinder head 206 is fixedly positioned on an upper surface or deck surface of the cylinder block 204 through a cylinder head gasket 238 by means of a plurality of first and second cylinder head-mounting bolts 240-1 and 240-2. These bolts 240-1 and 240-2 are inserted through first and second head-sided bolt holes 242-1 and 242-2 in the cylinder head 206, and further through cylinder head-mounting bolt holes of the cylinder block 204, i.e., first and second block-sided bolt holes 244-1 and 244-2, in which respective end portions of the bolts 240-1 and 240-2 are fitted to and threadingly engaged with first and second bolt-mounting, internally threaded portions 246-1 and 246-2 at deep portions of the bolt holes 244-1 and 244-2.

The crankcase 222 is mounted on the underside of the cylinder block 204 by a plurality of crankcase mounting bolts 248. The crank shaft 208 is rotatably supported on both of the cylinder block 204 and the crankcase 222. In addition, the cylinder head cover 226 is mounted on an upper surface of the cylinder head 206 through a cylinder head cover gasket 250.

The piston 212 is provided so as to be reciprocable along a cylinder sleeve 252. The cylinder sleeve 252 is cylindrically shaped, and is inserted and fitted in a cylinder bore (not shown) of the cylinder block 204. A head-side sleeve 254 is positioned on an upper surface of the cylinder sleeve 252, and is further arranged in series therewith. The head-side sleeve 254 is retained by the cylinder head 206, and is lower in height than the upper surface of the cylinder head 206. The crankcase-side sleeve 256 is located on the underside of the cylinder sleeve 252, and is further arranged in series therewith. The crankcase-side sleeve 256 is retained by the crank case 222.

The engine 202 has the following passages formed on the exhaust side thereof: a first head-side blowby gas passage 258, a first block-side blowby gas passage 260; and, a first crankcase-side blowby gas passage 270. The engine 202 is further formed with the following passages on the intake side thereof: a second head-side blowby gas passage 264; a second block-side blowby gas passage 266; and, a second crankcase-side blowby gas passage 268. The first and second head-side blowby gas passages 258 and 264 are open at an upper section of the cylinder head 206.

In the cylinder head cover 226, a fresh air-side breather chamber 274 and a gas-side breather chamber (PCV chamber) 276 are defined and formed therein by means of both a baffle plate 270 and a partition panel 272. The baffle plate 270 is situated substantially parallel to the upper surface of cylinder head 206. The partition panel 272 is substantially perpendicular to the baffle plate 270, thereby dividing the inside of the cylinder head cover 226 into intake and exhaust sides. The baffle plate 270 has a breather hole 278 formed on the exhaust side and a gas-through-hole 280 formed on the intake side.

The cylinder head cover 226 has a breather pipe 282 situated in and fitted to the fresh air-side breather chamber 274. The cylinder head cover 226 further has a flow rate-adjusting valve (PCV valve) 284 situated in and attached to the gas-side breather chamber 276.

At the breather pipe 282, there is provided a fresh air-introducing pipe 288 which is connected to the air cleaner 236, thereby forming a fresh air-introducing passage 286.

At the flow rate-adjusting valve 284, there is provided a gas-returning pipe 292 which is connected to the intake manifold 228 on the downstream side of the throttle valve 232, thereby forming a gas-returning passage 290.

Reference numeral 294 in FIG. 11 denotes an oil level gauge.

As illustrated in FIG. 12, after passing through between the piston 212 and the cylinder sleeve 252, the blowby gas is caused to flow through the second crankcase-side blowby gas passage 268, the second block-side blowby gas passage 266, and the second head-side blowby gas passage 264 from the inside of the crankcase-side sleeve 256. Thereafter, the blowby gas is at first released at the upper section of the cylinder head 206, and is then caused to flow into the gas-side breather chamber 276 through the aforesaid hole 280. The blowby gas is then admitted into the intake passage 230 through the gas-returning passage 290 by means of the flow rate-adjusting valve 284. The valve 284 operates on a state of intake pipe pressure which is generated in the intake passage 230. Then, the admitted blowby gas is driven into the combustion chamber 216 through the intake port 218, and is re-combusted therein. Meanwhile, fresh air from the air cleaner 236 is introduced into the fresh air-side breather chamber 274 through the breather pipe 282 along the fresh air-introducing passage 286. This fresh air is caused to flow through the first head-side blowby gas passage 258, the first block-side blowby gas passage 260, and the first crankcase-side blowby gas passage 262, whereby the blowby gas from the inside of the first crankcase-side sleeve 256 is expelled toward the second crankcase-side blowby gas passage 268.

As a result, such harmful blowby gas is re-combusted in the combustion chamber 216 without being released in the ambient air, while simultaneously fresh air is introduced therein, whereby the blowby gas and fresh air are constantly recycled.

Referring now to FIGS. 14–16, the cylinder head 206 is shown provided on and fastened to the cylinder block 204 through the cylinder gasket 238 by means of the first and second cylinder head-mounting bolts 240-1 and 240-2. These bolts 240-1 and 240-2 are inserted through the first and second block-side bolt holes 244-1 and 244-2, respectively. These bolt holes 244-1 and 244-2 are formed at first and second thick portions 296-1 and 296-2 of the cylinder block 204. These thick portions 296-1 and 296-2 are formed with the first and second block-side blowby gas passages 260 and 266 adjacent to the first and second block-side bolt holes 244-1 and 244-2, respectively.

The above holes 244-1 and 244-2 as well as the passages 260 and 266 are molded by means of respective molding pins (not shown).

Referring further to FIGS. 17–19, the cylinder head 206 is shown having the second head-side blowby gas passages 264 linearly formed at positions to avoid a cam shaft 214 which is located on one side of the cylinder head 206. In addition, as illustrated in FIG. 20, there are cases where the engine 202 is provided with the oil level gauge 294 which is inserted through the cylinder head cover 266 by the aid of the second head-side blowby gas passage 264, the second block-side blowby gas passage 266, and the second crankcase-side blowby gas passage 268. A handle portion 294*a* of the oil level gauge 294 is mounted at a gauge-mounting opening 298 which is formed at a gauge-mounting boss 226*a* of the cylinder head cover 226.

Such an engine having the blowby gas passages provided in the cylinder block is disclosed in, e.g., published Japanese Utility Model Application Laid-Open Nos. 2-96059, 63-61515, and 2-53512. According to the first cited publication, the blowby gas passages are provided straight through the cylinder block in a vertical direction thereof, with a reinforcing means being provided therein for the purpose of enhancement in rigidity. According to the second cited publication, lower openings of the blowby gas passages are formed open onto both sides of a crank chamber. According to the last cited publication, a chamber is formed substantially midway along the blowby gas passage.

With conventional types of blowby gas-returning systems, however, the first and second head-side blowby gas passages are opened at respective upper sections of the cylinder head. As illustrated in FIG. 13, fresh air from the fresh air-side breather chamber is thereby caused to take a shortcut across the upper section of the cylinder head, and then arrives at the gas-side breather chamber. As a result, it is impossible to smoothly return the blowby gas. This causes an inconvenience that accelerates deterioration in oil and degrades the lubricating performance of the engine.

In the structure of a cylinder block as shown in FIG. 15, the cylinder block is large and complex in shape, and is thus susceptible to porosity when being cast. In particular, the block-side blowby gas passages are located adjacent to the block-side bolt holes. This causes inconveniences in that the cylinder block is made larger in cubic volume, and a large quantity of casting porosity occurs, which thus contributes to defects in crude materials. In addition, the pins for use in molding of the block-side bolt holes and the blowby gas passages are made elongated because these bolt holes and passages have relatively smaller diameters. This causes another inconvenience in that the pins are prone to sand burning. Further, since surface pressure on the cylinder head gasket is concentrated adjacent to the block-side bolt holes, then surface pressure between contiguous cylinder head-mounting bolts is difficult to provide. This causes a yet further inconvenience in that the surface pressure on the cylinder head gasket is unevenly distributed, thereby reducing the sealing performance of the cylinder head gasket. Further, the blowby gas contains a large amount of oil in the form of atomized sprays. The blowby gas containing atomized oil spray is caused to flow upwardly through the blowby gas passages, and is then combusted. This causes still another inconvenience, namely an increase in the quantity of oil consumption.

Moreover, with a cylinder head as illustrated in FIGS. 18 and 19, an entire portion of each head-side blowby gas passage must linearly be formed in a vertical direction thereof in order to avoid a cam shaft. This causes a further inconvenience in that the width of the cylinder head in the transverse direction thereof is increased, with a consequential increase in size of the engine. In addition, an oil level gauge as illustrated in FIG. 20 is supported on the cylinder head cover at only one location of a gauge-mounting opening thereof. This causes inconveniences in that a handle portion of the oil level gauge is shaken, and oil leakage occurs, with the result that the oil level gauge operates unreliably.

SUMMARY OF THE INVENTION

To obviate the above-mentioned inconveniences, the present invention provides a blowby gas-returning structure for an engine, in which a blowby gas passage is provided in both a cylinder block and a cylinder head in such a manner that a blowby gas flowing between the engine piston and cylinder sleeve is introduced into a gas-side breather chamber, the chamber being formed by a baffle plate within a cylinder head cover, and wherein a passage-forming member is provided in order to hold the blowby gas passage in continuous communication with the gas-side breather chamber without such communication being interrupted along the blowby gas passage.

Further, the present invention provides a blowby gas-returning structure for an engine, in which a blowby gas passage is provided in both the cylinder block and cylinder head in such a manner that a blowby gas flowing through between the piston and the cylinder sleeve is introduced into a gas-side breather chamber, the chamber being formed by a baffle plate within a cylinder head cover, and wherein the cylinder block is provided with a void space section which shares space with a cylinder head-mounting bolt hole and the blowby gas passage.

In addition, the present invention provides a blowby gas-returning structure for an engine, in which a blowby gas passage is provided in both the cylinder block and the cylinder head in such a manner that a blowby gas flowing through between the piston and cylinder sleeve is introduced into a gas-side breather chamber, the chamber being formed by a baffle plate within a cylinder head cover, and wherein the blowby gas passage in the cylinder head is transversely offset substantially midway along the length thereof.

Pursuant to the present invention, the blowby gas passage in both of the cylinder block and cylinder head is continuously provided to the gas-side breather chamber without a pause therealong. As a result, fresh air provides a smooth return of the blowby gas, whereby oil degradation can be minimized, and resulting in enhanced engine lubrication performance.

In addition, the cylinder block is provided with the void space section which shares space with the cylinder head-mounting bolt hole and the blowby gas passage. This structure provides a lightweight cylinder block. The above structure further can prevent the formation of a porous cylinder block when the cylinder block is cast. Further, the molding pin may be made larger in diameter, thereby preventing sand-burning of the molding pin. Yet further, surface pressure between the neighboring cylinder head-mounting bolts can easily be provided so as to evenly distribute the surface pressure on the cylinder head gasket, thereby enhancing the sealing performance of the cylinder head gasket. Still further, the amount of oil in the blowby gas can be reduced to realize a reduction on oil consumption.

In addition, the blowby gas passage in the cylinder head is offset substantially midway therealong. This structure reduces the width of the cylinder head in the transverse direction thereof, resulting in a compact engine. Further, the above structure forces bending of the oil level gauge, thereby preventing shaking of the handle portion of the oil level gauge. As a result, oil leakage can be prevented, and thus the oil level gauge is steadily operable.

DETAIL DESCRIPTION

Embodiments of the present invention will now be described in specific detail with reference to the drawings.

Figure 1:
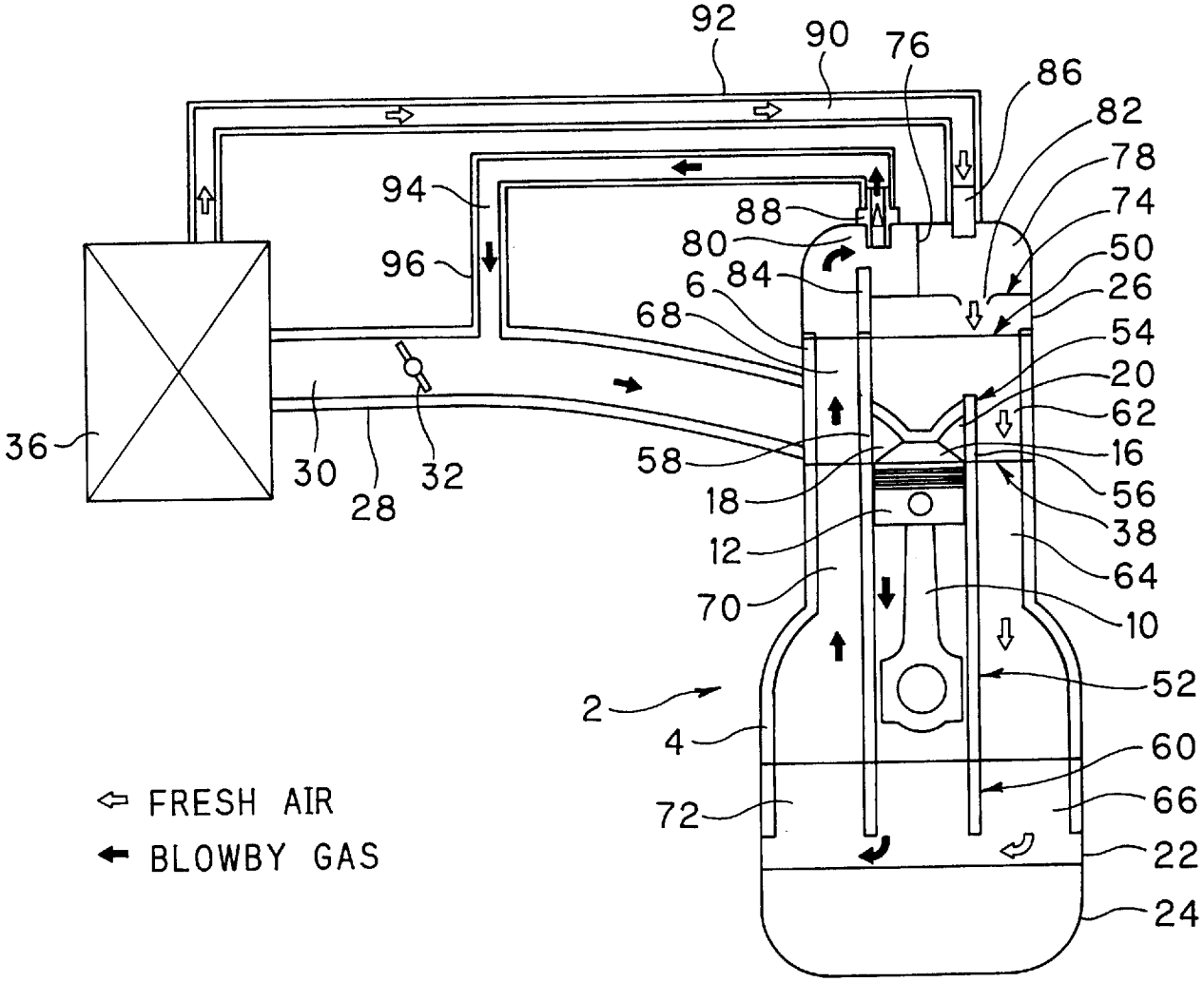
FIG. 1 is a structural view illustrating a blowby gas-returning structure for an engine according to a first embodiment of the invention.
Figure 2:
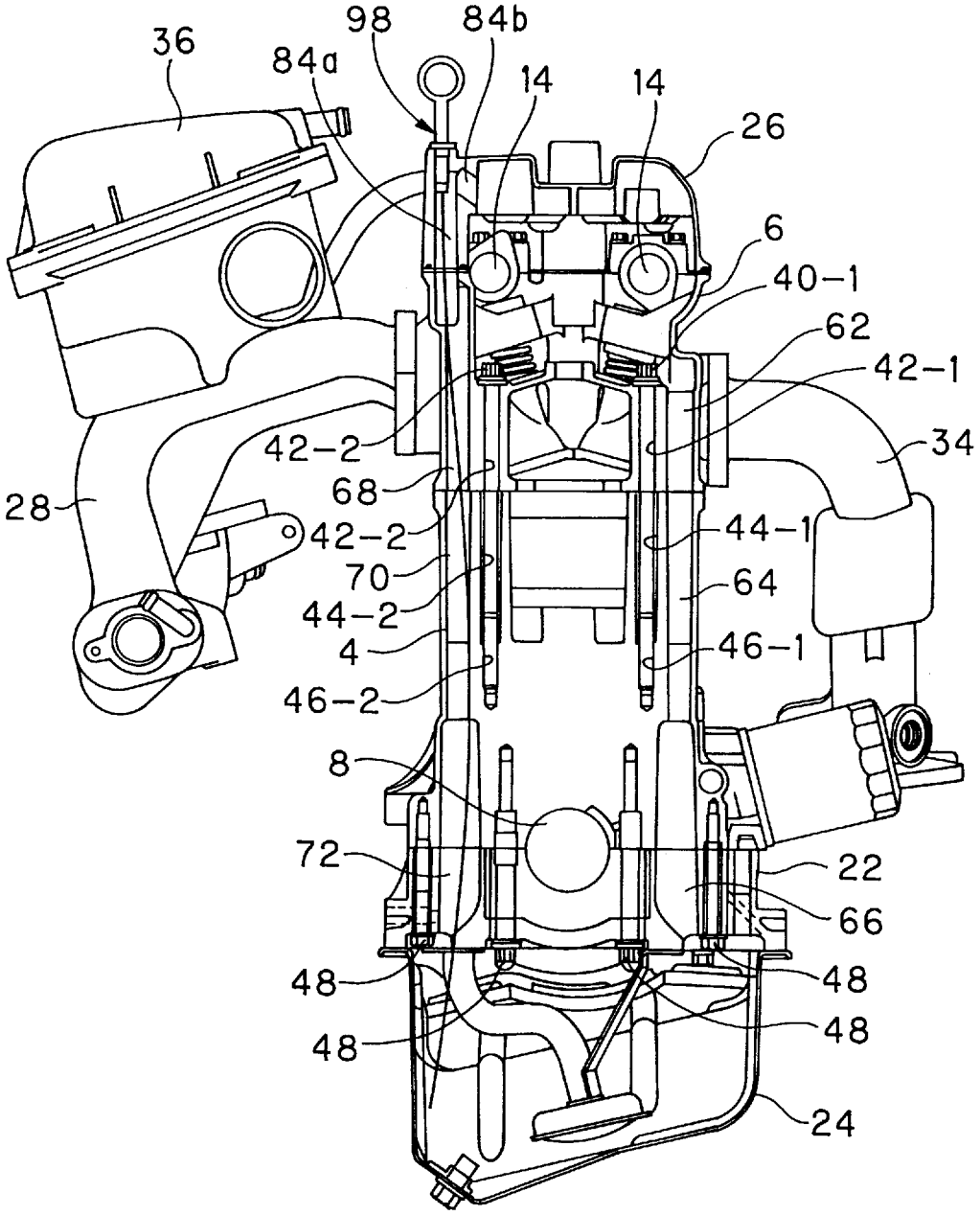
FIG. 2 is a cross-sectional view illustrating an engine according to the first embodiment.

FIGS. 1 and 2 illustrate a first embodiment. In FIGS. 1 and 2, 2 denotes an engine; 4 a cylinder block; 6 a cylinder head; 8 a crank shaft; 10 a connecting rod; 12 a piston; 14 cam shafts; 16 a combustion chamber; 18 an intake port; 20 an exhaust port; 22 a crankcase; 24 an oil pan; 26 a cylinder head cover; 28 an intake manifold; 30 an intake passage; 32 a throttle valve; 34 an exhaust manifold; and 36 an air cleaner.

The cylinder head 6 is fixedly positioned on an upper surface or deck surface of the cylinder block 4 through a cylinder head gasket 38 by a plurality of first and second cylinder head-mounting bolts 40-1 and 40-2. These bolts 40-1 and 40-2 are inserted through first and second head-side bolt holes 42-1 and 42-2 of the cylinder head 6, and further through cylinder head-mounting bolt holes of the cylinder block 4, i.e., first and second block-side bolt holes 44-1 and 44-2, in which respective end portions of the bolts 40-1 and 40-2 are attached to and threadingly engaged with first and second bolt-mounting, internally threaded portions 46-1 and 46-2 at deep portions of the bolt holes 44-1 and 44-2.

The crankcase 22 is mounted on the underside of the cylinder block 4 by a plurality of crankcase-mounting bolts 48. The crank shaft 8 is rotatably supported on both of the cylinder block 4 and the crankcase 22. In addition, the cylinder head cover 26 is mounted on an upper surface of the cylinder head 6 through a cylinder head cover gasket 50.

The piston 12 is provided so as to be reciprocable along a cylinder sleeve 52. The cylinder sleeve 52 is cylindrically shaped, and is inserted and fitted in a cylinder bore (not shown) of the cylinder block 4.

A head-side sleeve 54 is positioned on an upper surface of the cylinder sleeve 52, and is further arranged in series therewith. The head-side sleeve 54 is retained by the cylinder head 6. The head-side sleeve 54 has a first sleeve wall portion 56 on the exhaust side thereof and a second sleeve wall portion 58 on the intake side thereof. The first sleeve wall portion 56 is lower in height than the upper surface of the cylinder head 6. The second sleeve wall portion 58 is as high as the upper surface of the cylinder head 6.

A crankcase-side sleeve 60 is located on the underside of the cylinder sleeve 52, and is further arranged in series therewith. The crankcase-side sleeve 60 is retained by the crankcase 22.

The engine 2 is thereby formed with the following passages on the exhaust side thereof, which passages are in communication with each other: a first head-side blowby gas passage 62; a first block-side blowby gas passage 64; and a first crankcase-side blowby gas passage 66. The engine 2 is further formed with the following passages on the intake side thereof, which passages are in communication with each other: a second head-side blowby gas passage 68; a second block-side blowby gas passage 70; and a second crankcase-side blowby gas passage 72. The passages 62, 64, 66 thus form a continuous blowby passage on the exhaust side, and the passages 68, 70, 72 form a continuous blowby passage on the intake side.

The first head-side blowby gas passage 62 is open to an upper section of the cylinder head 6. On the other hand, the second head-side blowby gas passage 68 is not open to the upper section of the cylinder head 6.

In the cylinder head cover 26, a fresh air-side breather chamber 78 and a gas-side breather chamber (PCV chamber) 80 are defined and formed therein by means of both a baffle plate 74 and a partition panel 76. The baffle plate 74 is situated substantially parallel to the upper surface of cylinder head 6. The partition panel 76 is substantially perpendicular to the baffle plate 74, thereby dividing the inside of the cylinder head cover 26 into intake and exhaust sides. The baffle plate 74 is formed with a breather hole 82 on the exhaust side.

A passage-forming object (i.e., a wall) 84 is provided on and connected to an upper surface of the second sleeve wall portion 58 of the head-side sleeve 54. The passage-forming wall 84 contacts the baffle plate 74, and is designed to maintain the second head-side blowby gas passage 68 and the gas-side breather chamber 80 in continuous fluid communication with one another without interruption, but also isolates the upper section of the cylinder head 6 from the passage 68. As a result, the gas-side breather chamber 80, the second head-side blowby gas passage 68, the second block-side blowby gas passage 70, and the second crankcase-side blowby gas passage 72 continuously fluidly communicate with each other without such communication being interrupted halfway therealong.

The cylinder head cover 26 has a breather pipe 86 situated in and attached to the fresh air-side breather chamber 78. The cylinder head cover 26 further has a flow rate-adjusting valve (pollution control valve or PCV valve) 88 located in and fitted to the gas-side breather chamber 80.

At the breather pipe 86, there is provided a fresh air-introducing pipe 92 which is connected to an air cleaner 36, thereby forming a fresh air-introducing passage 90.

At the flow rate-adjusting valve 88, there is provided a gas-returning pipe 96 which is connected to the intake manifold 28 on the downstream side of the throttle valve 32, thereby forming a gas-returning passage 94.

Reference numeral 98 in FIG. 2 denotes an oil level gauge. The oil level gauge 98 is inserted through a first cover-side blowby gas passage 84*a* which is provided in the cylinder head cover 26. This first passage 84*a* communicates with the gas-side breather chamber 80 through a second cover-side blowby gas passage 84*b*.

The operation of the first embodiment (FIGS. 1 and 2) will now be briefly described.

After passing through between the piston 12 and the cylinder sleeve 52, the blowby gas reaches the gas-side breather chamber 80 from the inside of the crankcase-side sleeve 60 through the second crankcase-side blowby gas passage 72, the second block-side blowby gas passage 70, and the second head-side blowby gas passage 68 without a pause therealong. The flow rate-adjusting valve 88 is operated based on a state of intake pipe pressure, and the blowby gas is thereby caused to flow into the intake passage 30 through the gas-returning passage 94. Then, the blowby gas is supplied to the combustion chamber 16 through the intake port 18, and is again combusted therein.

Upon such discharging of the aforesaid blowby gas for re-combustion, fresh air from the air cleaner 36 is caused to flow into the fresh air-side breather chamber 78 through the fresh air-introducing passage 90.

The preceding fresh air is reliably driven out of the breather chamber 78 toward the first head-side blowby gas passage 64 through the breather hole 82 without taking a shortcut across the upper section of the cylinder head 6 because the gas-side breather chamber 80 is isolated from both the fresh air-side breather chamber 78 and the upper section of the cylinder head 6 by means of the partition wall 76, the passage-forming wall or object 84, and the baffle plate 74. Accordingly, the aforesaid fresh air positively expels the blowby gas from the inside of the crankcase-side sleeve 60 toward the second crankcase-side blowby gas passage 72. As a result, it is possible to provide smooth returning of the blowby gas, and thus to minimize oil degradation. Consequently, it is possible to enhance the lubricating performance of the engine 2.

Figure 3:
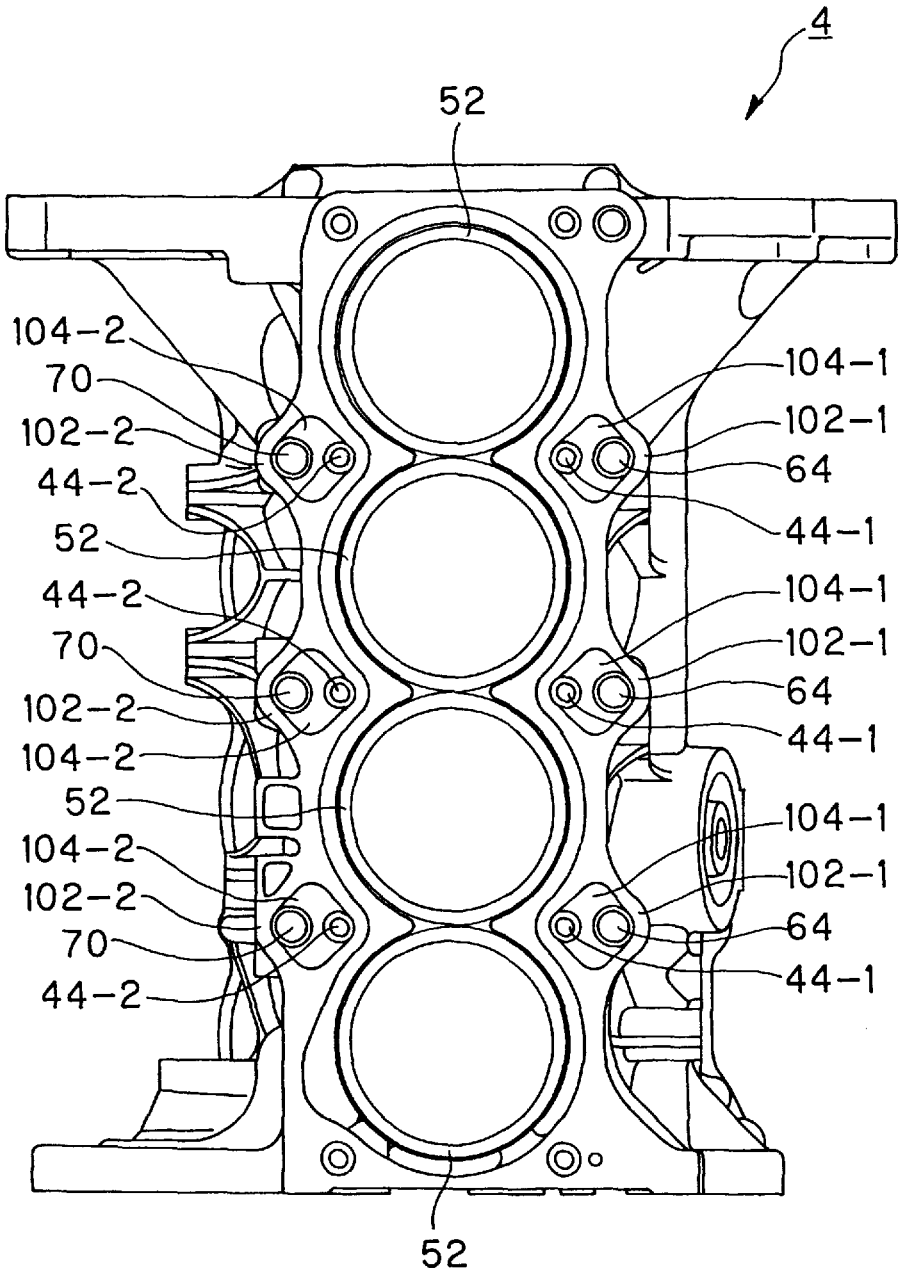
FIG. 3 is a plan view illustrating a cylinder block according to a second embodiment.
Figure 4:
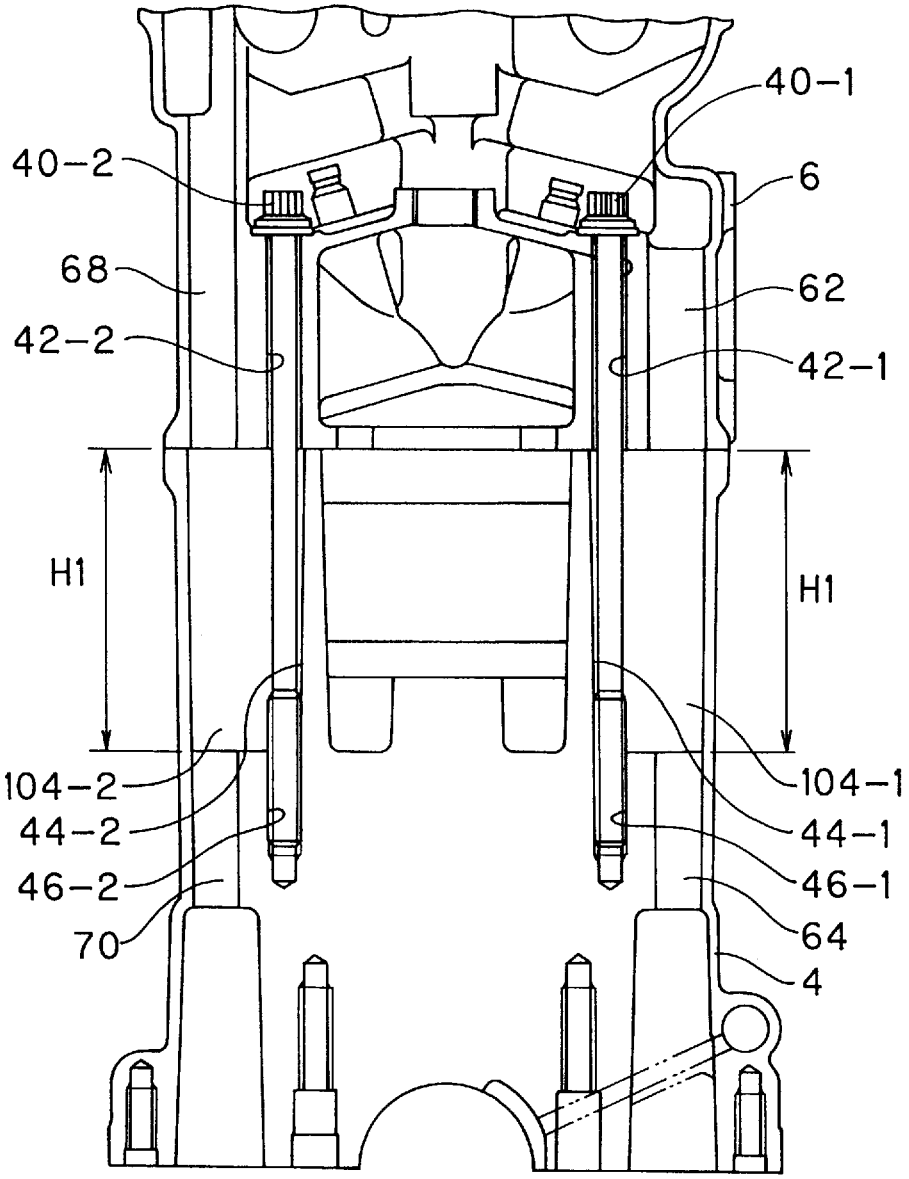
FIG. 4 is a partial cross-sectional view showing an engine according to the second embodiment.

FIGS. 3 to 6 illustrate a second embodiment of the invention. In this embodiment, the same reference numerals are hereinafter used to identify features identical in function to those described in the aforesaid first embodiment. This second embodiment is characterized as follows:

In a cylinder block 4 as illustrated in FIGS. 3 and 4, first void space sections or open regions 104-1 are formed at first thick portions 102-1 on the exhaust side thereof so as to share space with first block-side bolt holes 44-1 and first block-side blowby gas passages 64. Further, second void space sections or open regions 104-2 are formed at second thick portions 102-2 on the intake side of cylinder block 4 so as to share space with second block-side bolt holes 44-2 and second block-side blowby gas passages 70. The first and second void space sections 104-1 and 104-2 are cast to, e.g., a square-cornered shape by means of a molding pin (not shown) which has a greater diameter. In addition, these space sections 104-1 and 104-2 are formed at and extend downward from the deck surface of the block, and terminate at a depth H1 therefrom. The first and second bolt-mounting, internally threaded portions 46-1 and 46-2 are provided at a location spaced apart or downwardly from the deck surface in order to provide large formation of the first and second void space sections 104-1 and 104-2.

In addition, depth H1 of the first and second void space sections 104-1 and 104-2 can be set to any depth between the deck surface and the first and second internally threaded portions 46-1 and 46-2.

Figure 5:
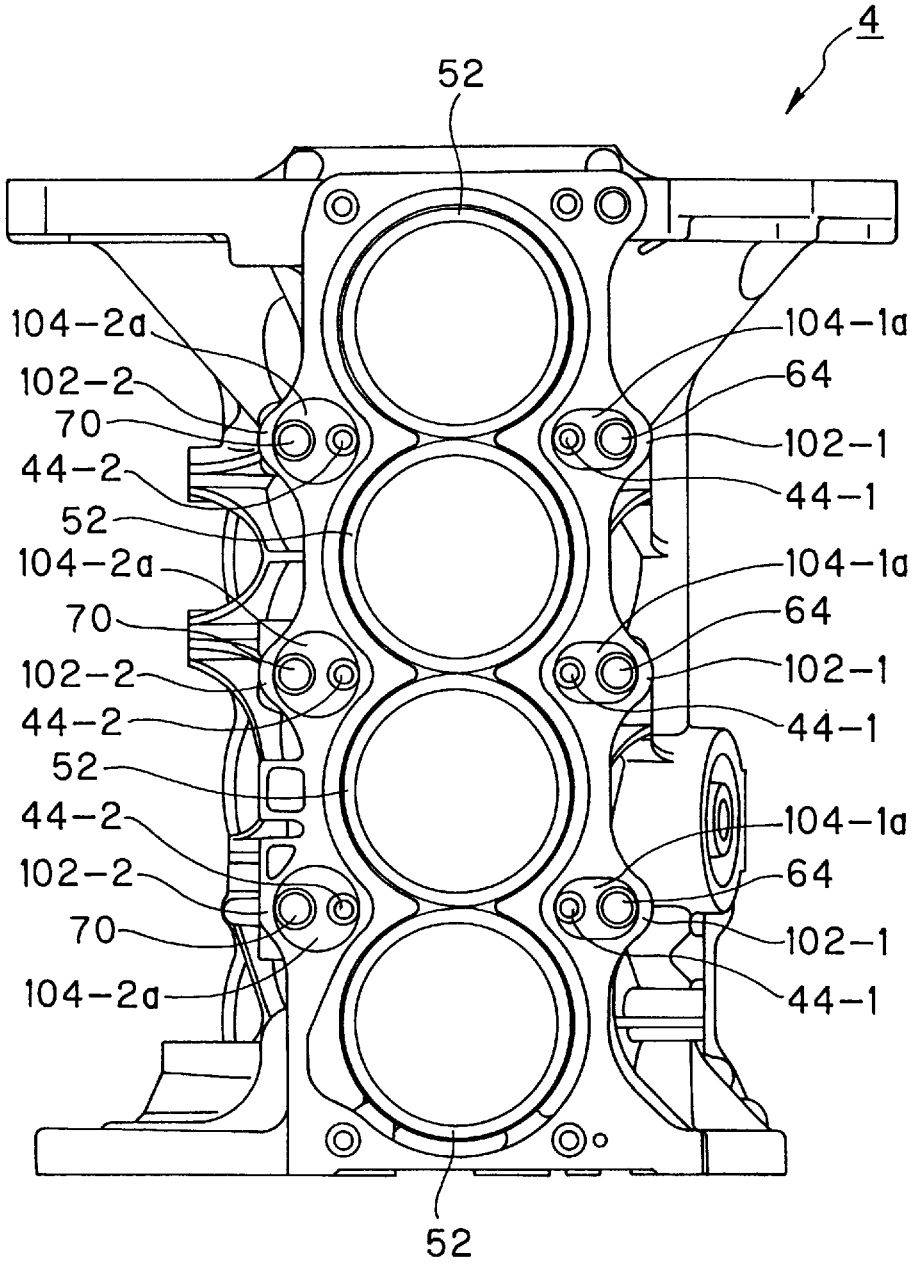
FIG. 5 is a plan view showing another cylinder block according to the second embodiment.

Further, void space sections 104 may be formed into other different shapes. For example, as illustrated in FIG. 5, the use of molding pins having different cross-sectional shapes causes the void space sections 104 to be formed into: circular-shaped first void space sections 104-2*a* on the intake side thereof; and elliptically shaped second void space sections 104-1*a* on the exhaust side thereof.

Figure 6:
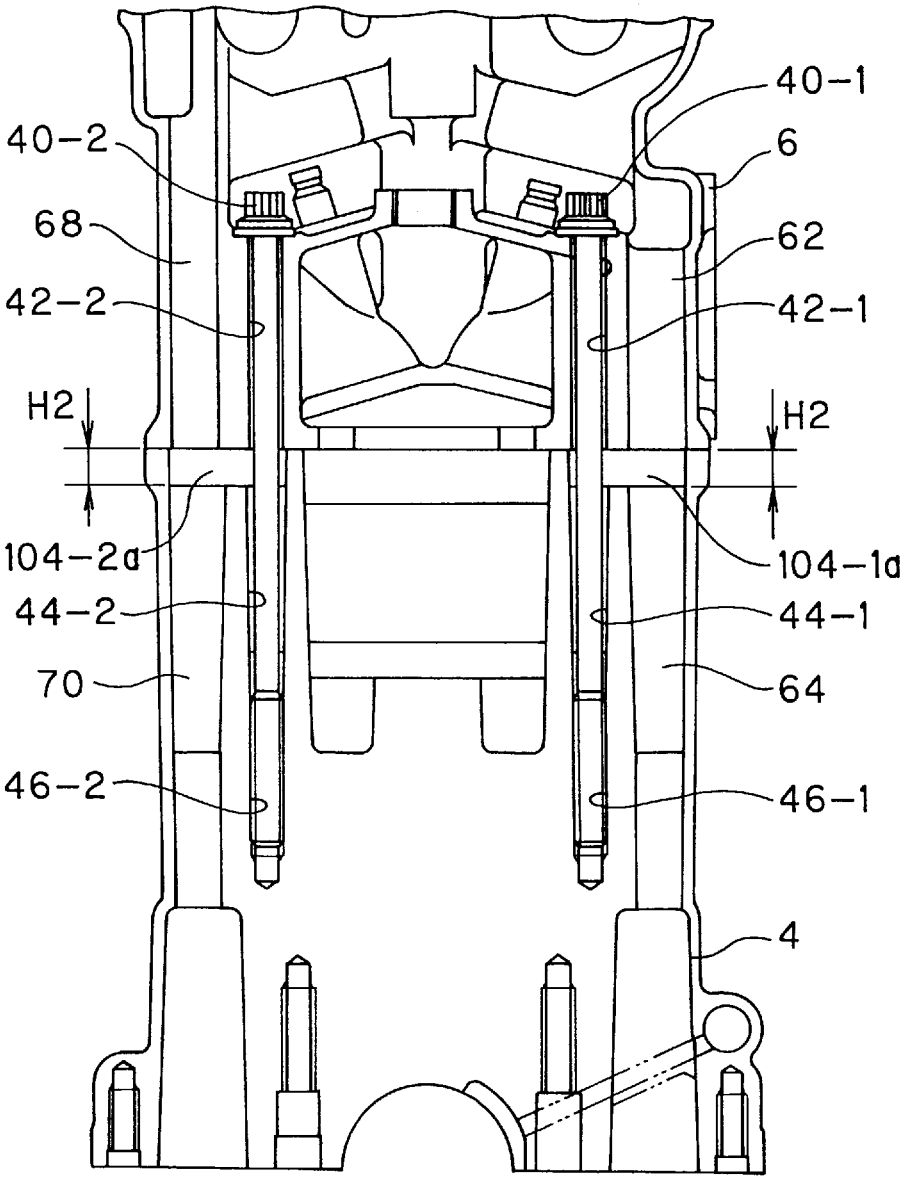
FIG. 6 is a partial cross-sectional view showing another engine according to the second embodiment.
Figure 7:
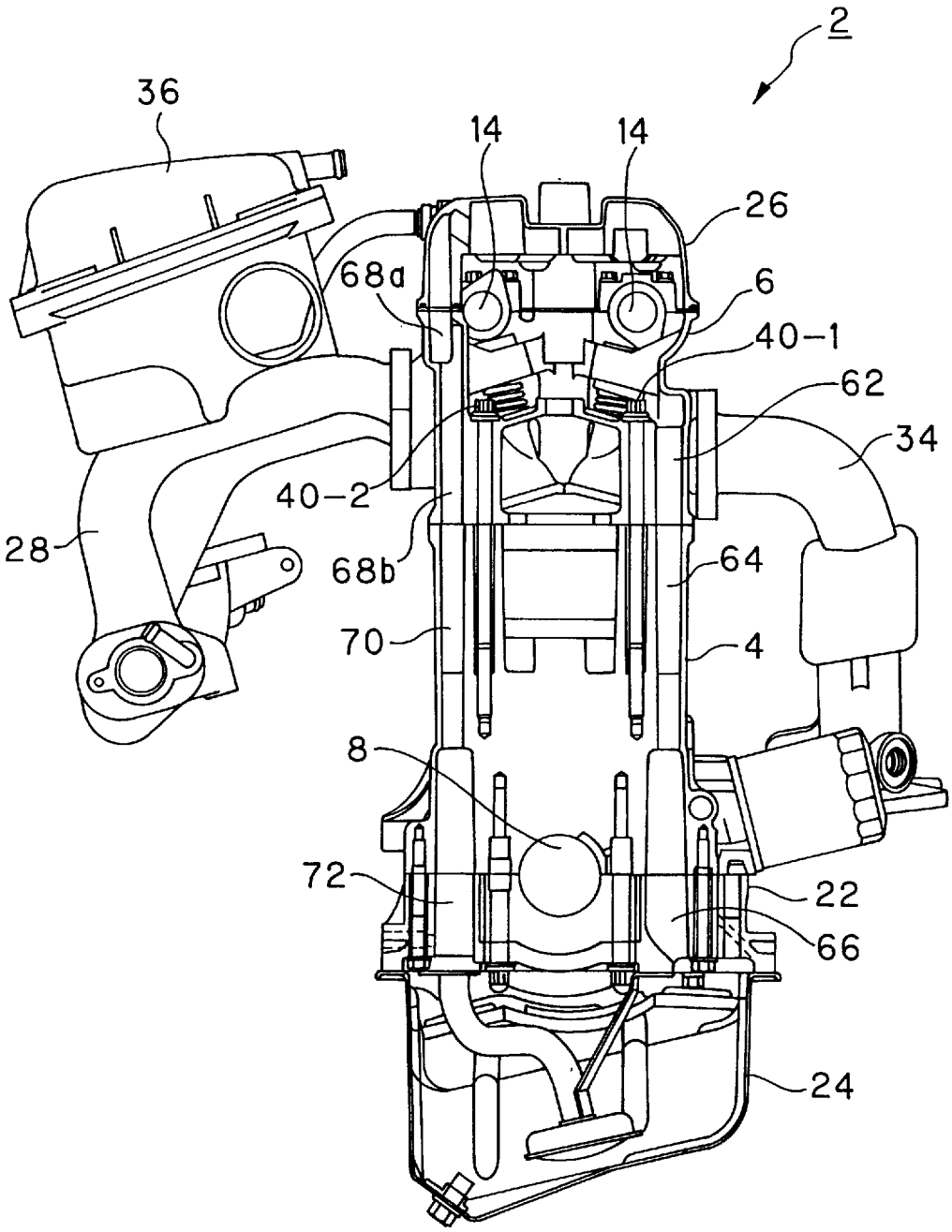
FIG. 7 is a cross-sectional view illustrating an engine according to a third embodiment.
Figure 8:
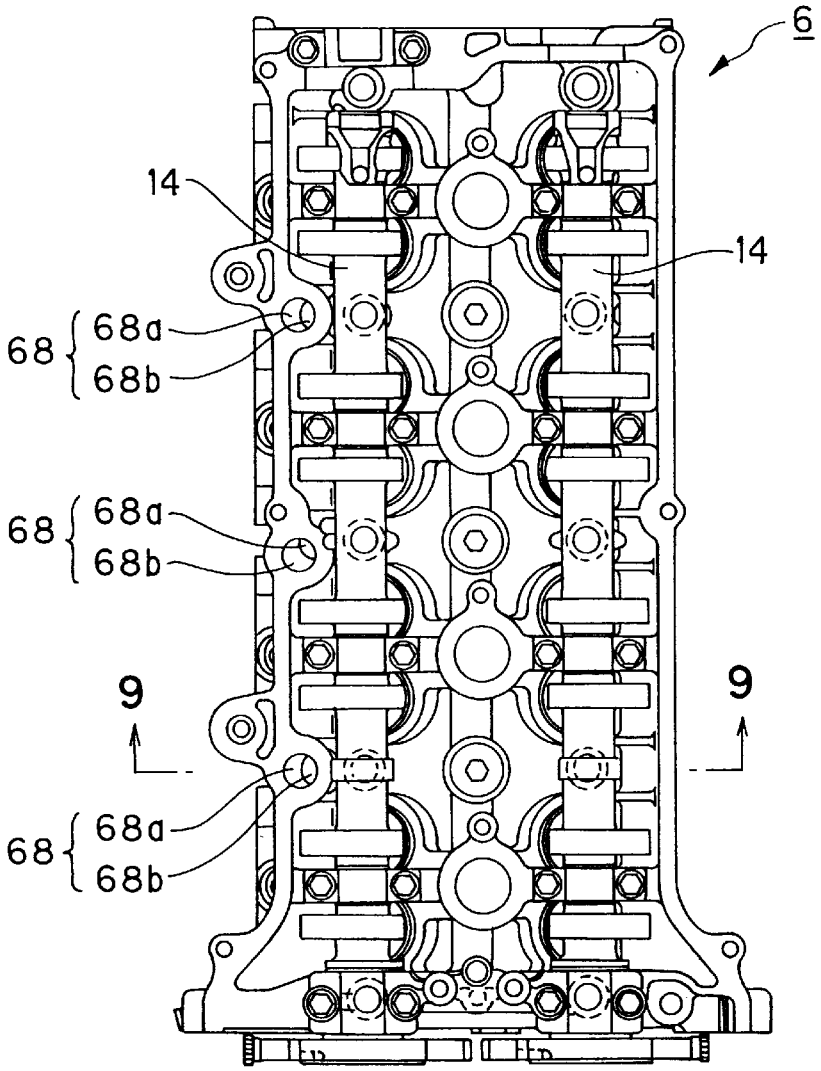
FIG. 8 is a plan view illustrating a cylinder head according to the third embodiment.
Figure 9:
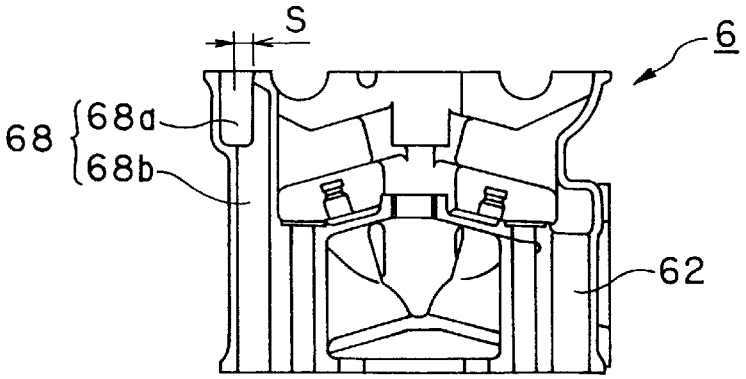
FIG. 9 is a cross-sectional view taken along line 9—9 in FIG. 8.

Yet further, as illustrated in FIG. 6, the depth of the first and second void space sections 104-1 and 104-2 from the deck surface can be set to H2 which is smaller than the preceding H1.

The structure pursuant to the second embodiment (FIGS. 3–6) has large void space sections 104 formed at the thick portions 102 to share with the block-side bolt holes and the blowby gas passages. As a result, the cylinder block 4 can be made lighter in weight. In addition, the occurrence of porosity in the cylinder block 4 can be prevented when being cast.

Further, the molding pin for forming such large void space sections 104 can be made larger in diameter (or cross section) than conventional pins. As a result, the molding pin can be prevented from experiencing sand-burning at the time of casting.

Still further, the void space sections 104 exist near the block-side bolt holes 44, at which surface pressure on the cylinder head gasket 38 are the most susceptible to emergence. As a result, it is possible to easily provide surface pressure between the neighboring cylinder head-mounting bolts 40, and to equalize the distribution of the surface pressure on the cylinder head gasket 38, with a consequential improvement in the sealing performance of the cylinder head gasket 38.

Furthermore, when the blowby gas containing a large amount of oil passes through the void space sections 104, then a sharp increase in flow passage area occurs, thereby reducing flow velocity of the blowby gas. Accordingly, when movement of the oil contained in the blowby gas overcomes the pressure of the blowby gas, then the oil falls down in opposition to the flow stream of the blowby gas. As a result, the amount of oil in the blowby gas can be reduced, and thus oil consumption can be reduced.

Reference is now made to FIGS. 7 to 10 which illustrate a third embodiment of the invention.

This embodiment is characterized in that cylinder head 6 has each second head-side blowby gas passage 68 positioned offset substantially midway therealong by a predetermined distance "S", and the passage 68 is thereby formed by upper and lower passages, i.e., a second head upper side blowby gas passage 68*a* and a second head lower side blowby gas passage 68*b*. More specifically, the second head upper side blowby gas passages 68*a* are formed at a location to avoid cam shaft 14. Meanwhile, the second head lower side blowby gas passages 68*b*are formed offset from the upper side passages 68*a* inwardly toward the center of the engine 2 by distance "S". That is, the lower side passages 68*b*are situated toward the center of the engine 2, and are further provided at a location where there is no need to avoid the cam shaft 14. In particular, the central passages 68*a* and 68*b* are disposed offset in a direction of the cam shaft as well.

The structure according to the third embodiment has the second head lower side blowby gas passages 68*b*disposed offset toward the center of the engine 2. Accordingly, the width of the cylinder head 6 in the transverse direction thereof is made smaller, which then provides a compact cylinder head 6. As a result, the entire engine 2 can be made compact in size.

Figure 10:
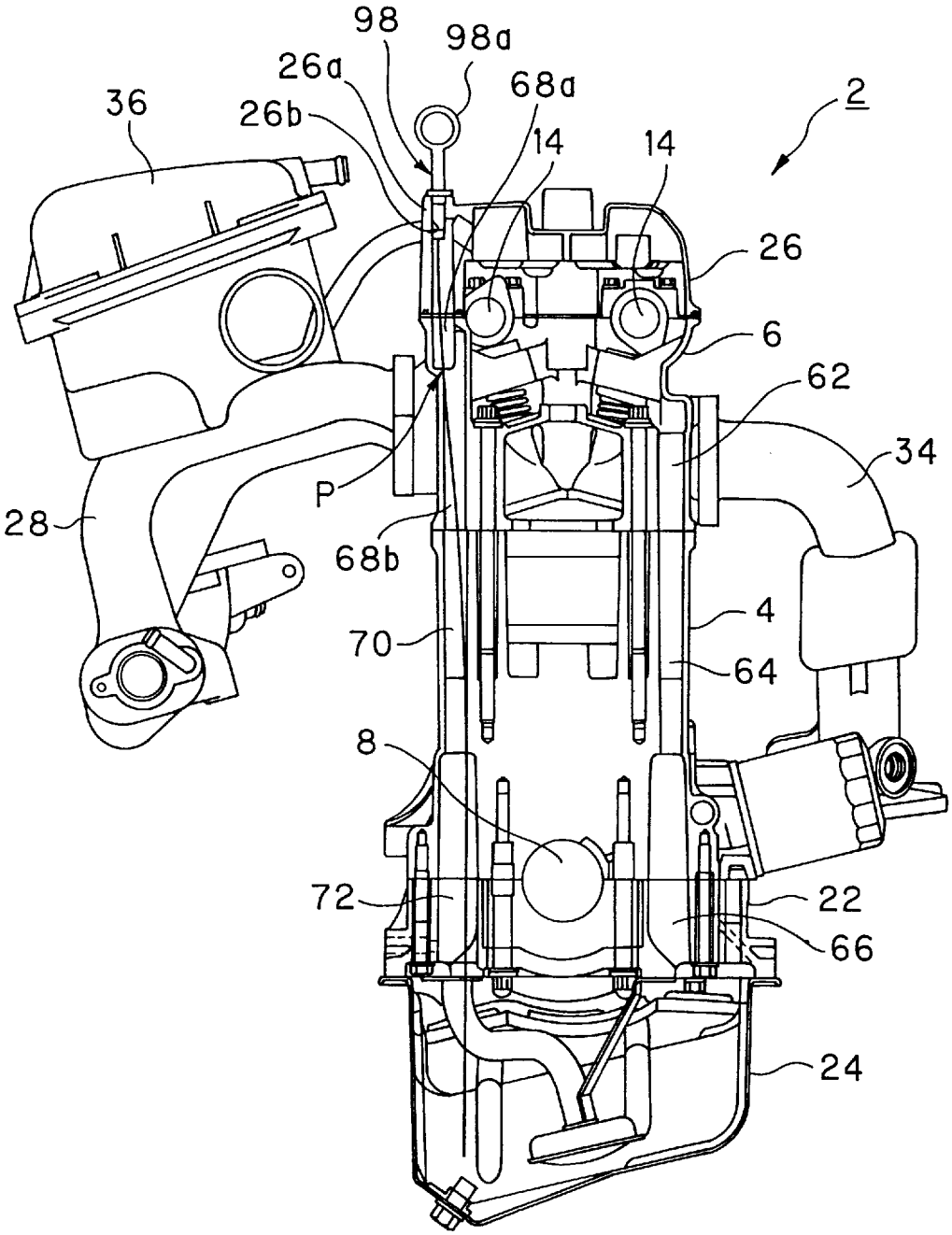
FIG. 10 is a cross-sectional view illustrating an engine having an oil level gauge disposed thereon according to the third embodiment.
Figure 11:
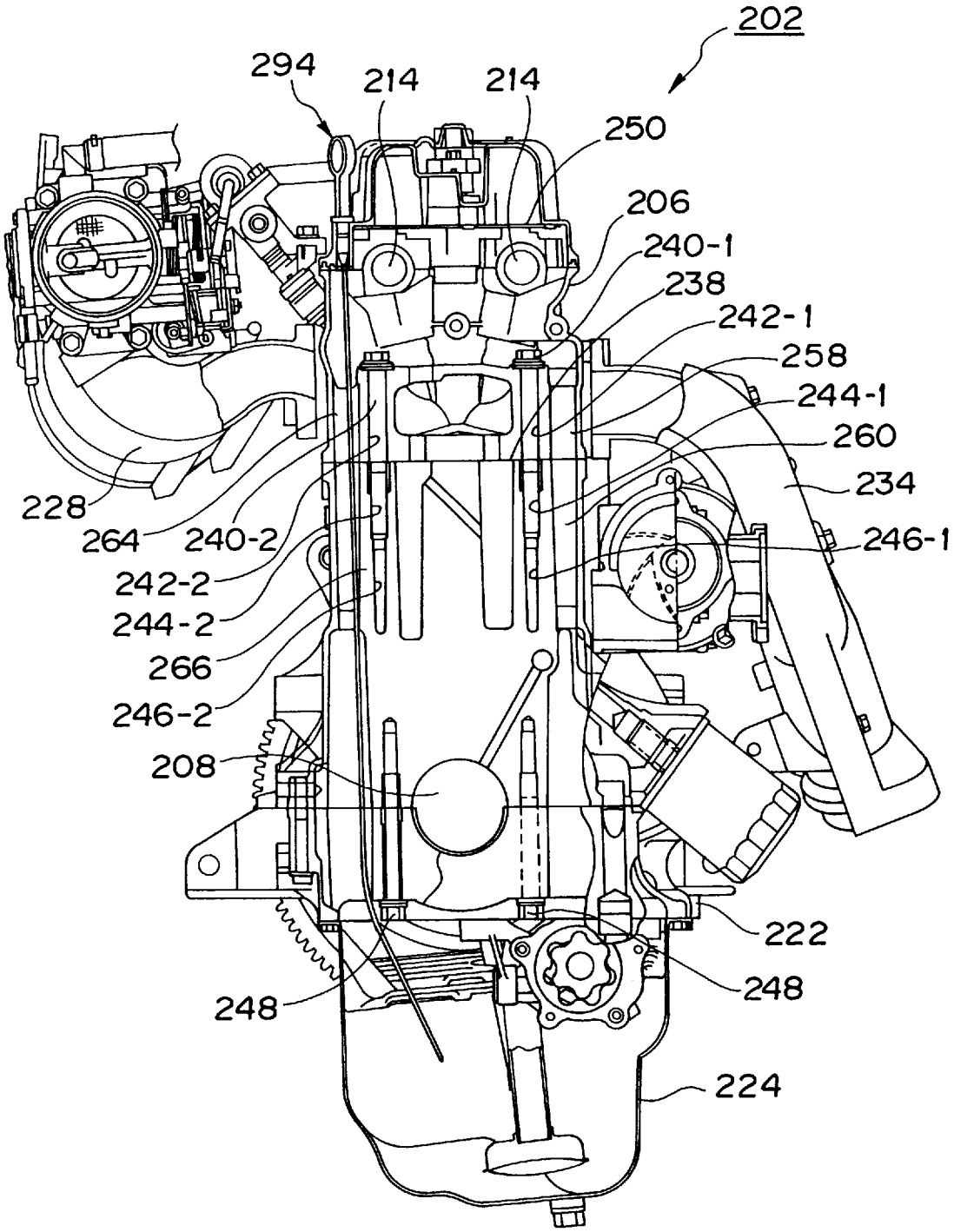
FIG. 11 PRIOR ART
FIG. 11 is a cross-sectional view showing a conventional engine.
Figure 12:
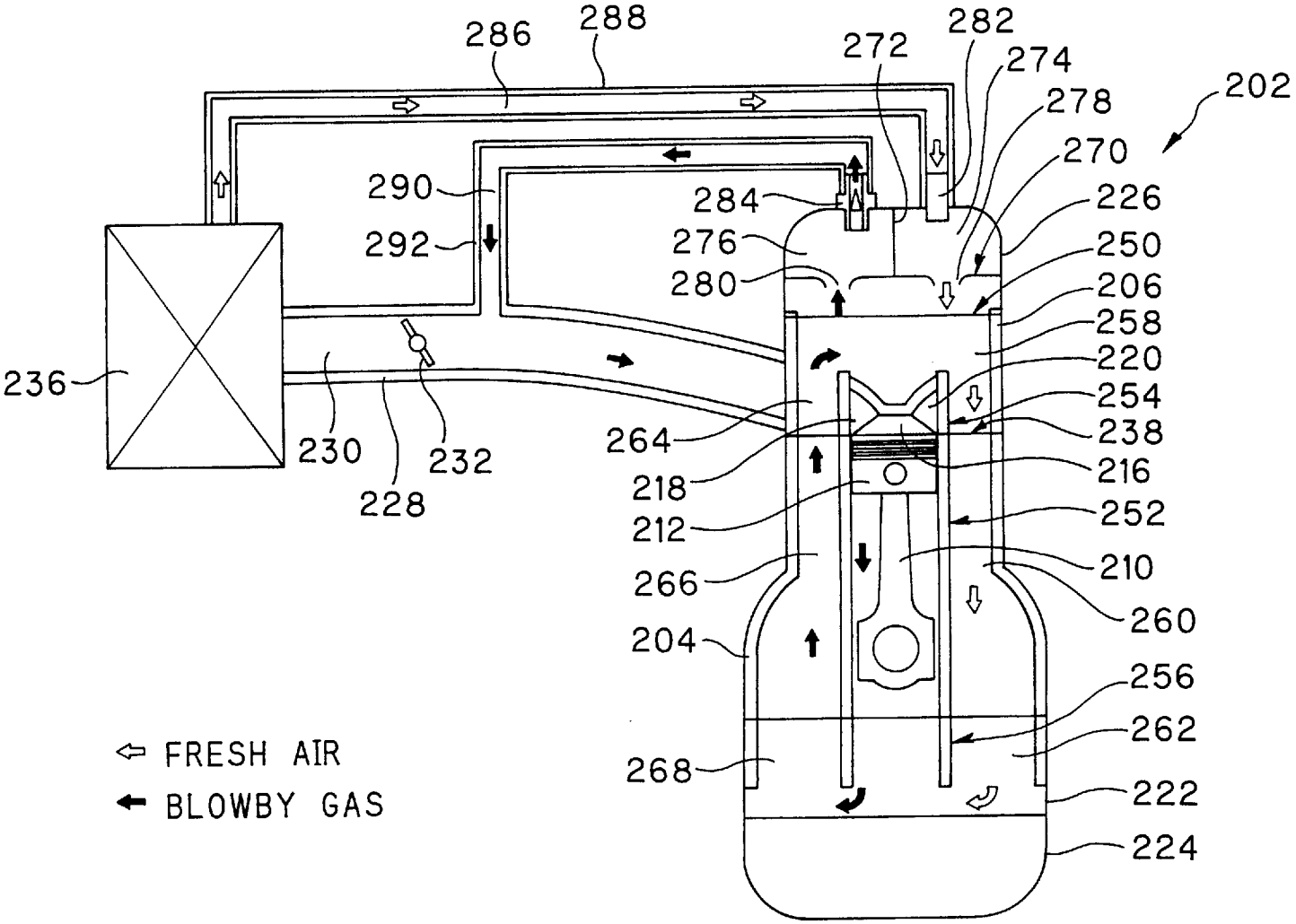
FIG. 12 PRIOR ART
FIG. 12 is a structural view illustrating a conventional blowby gas-returning structure for the engine of FIG. 11.
Figure 13:
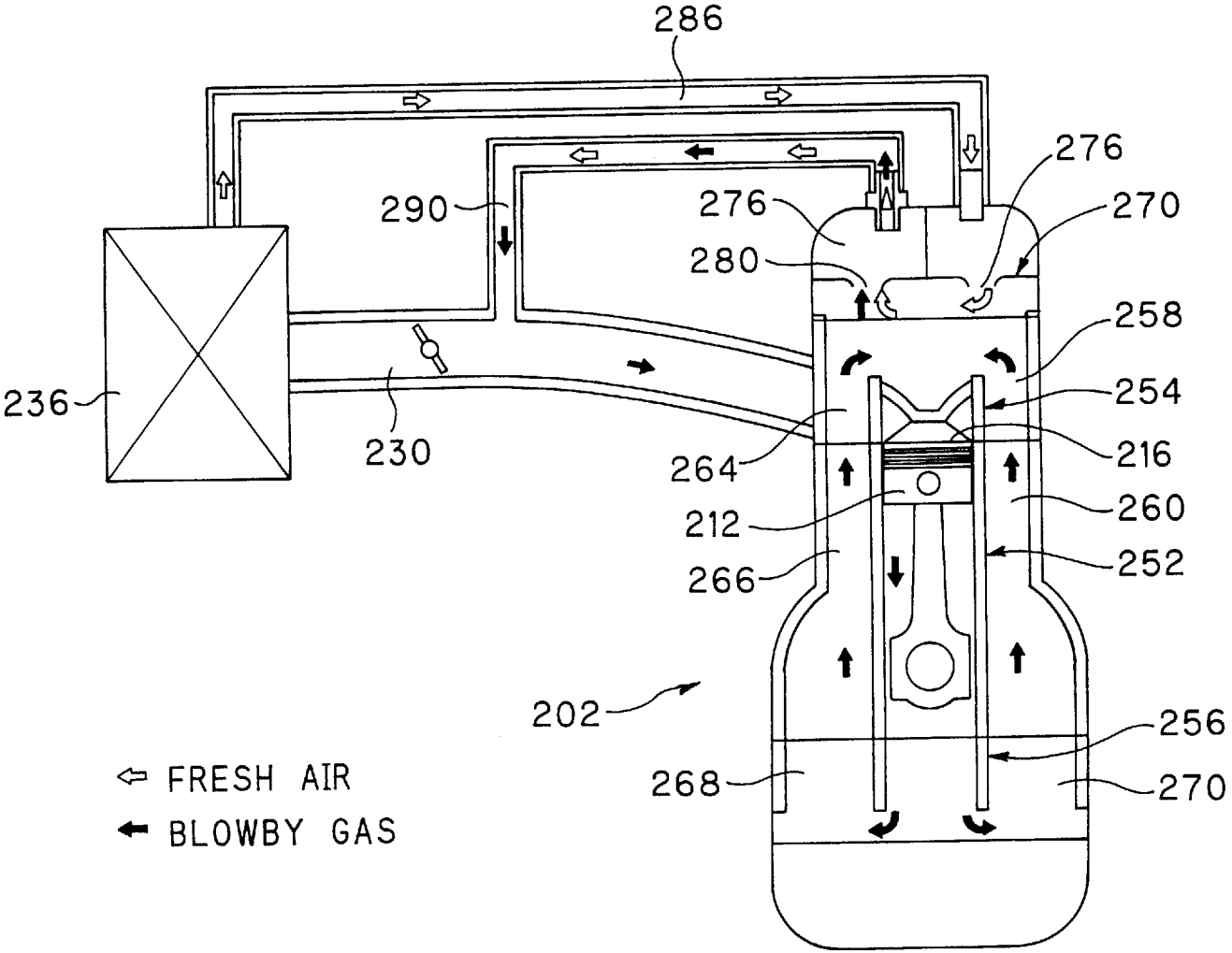
FIG. 13 PRIOR ART
FIG. 13 is a structural view showing a flow stream of a blowby gas in FIG. 12.
Figure 14:
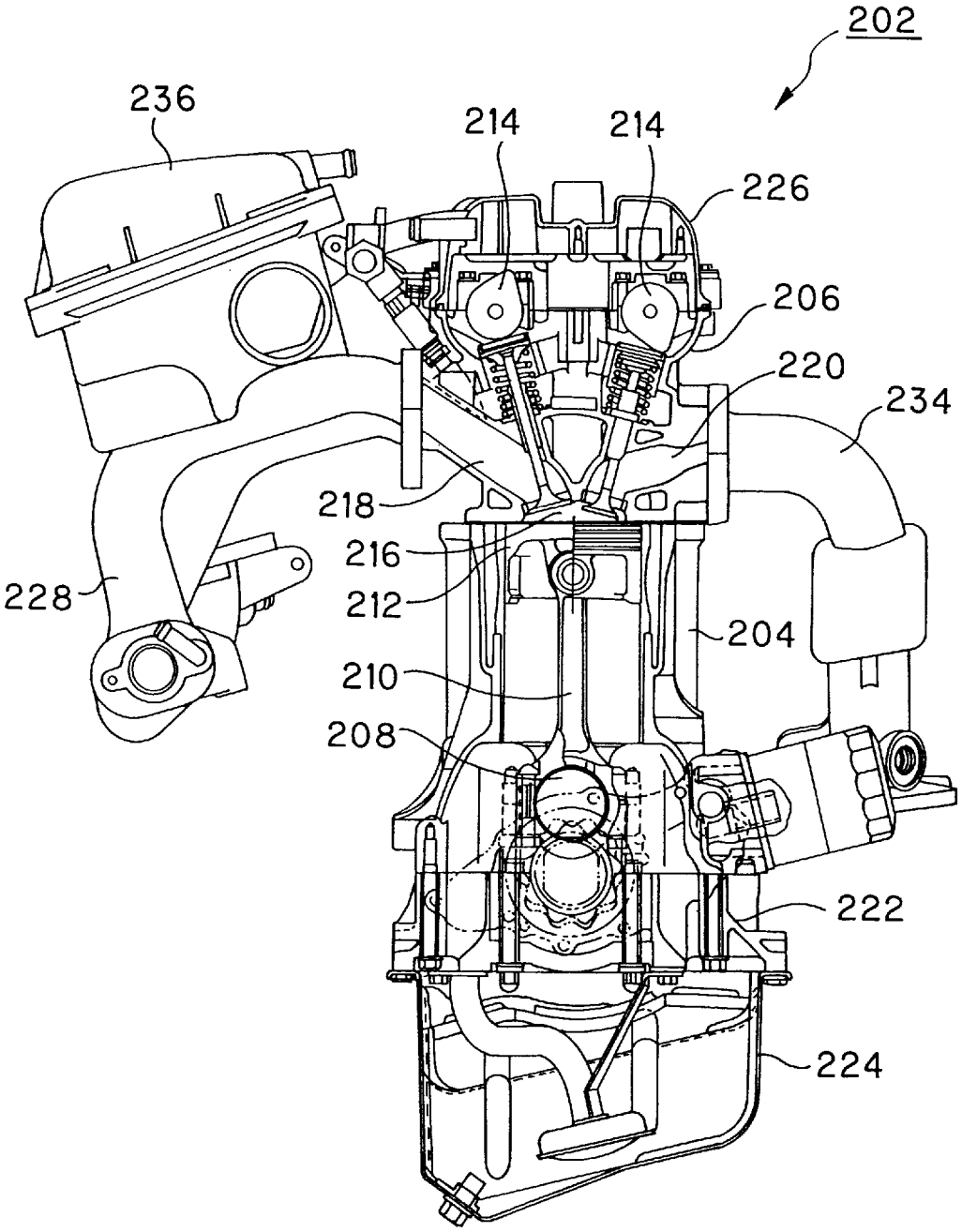
FIG. 14 PRIOR ART
FIG. 14 is a cross-sectional view illustrating another conventional engine.
Figure 15:
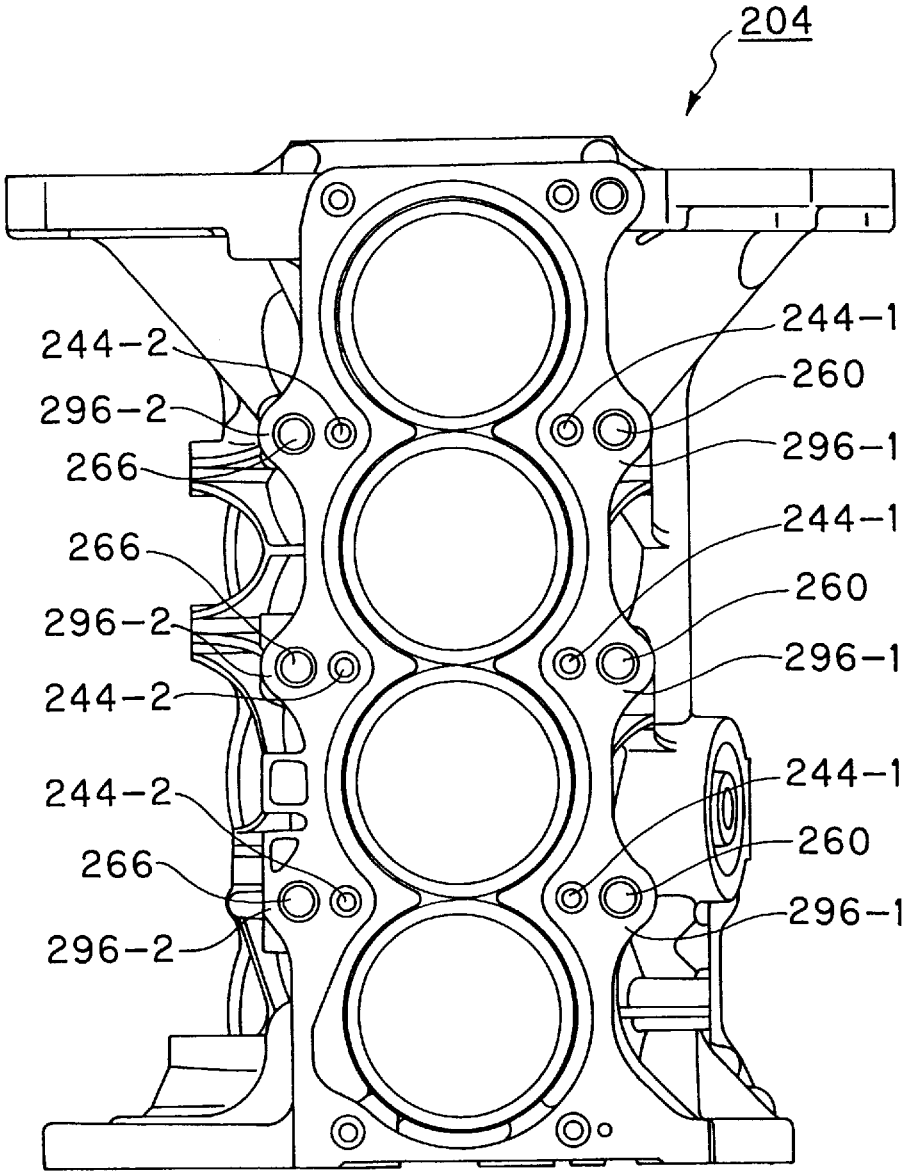
FIG. 15 PRIOR ART
FIG. 15 is a plan view of the cylinder block for the engine of FIG. 14.
Figure 16:
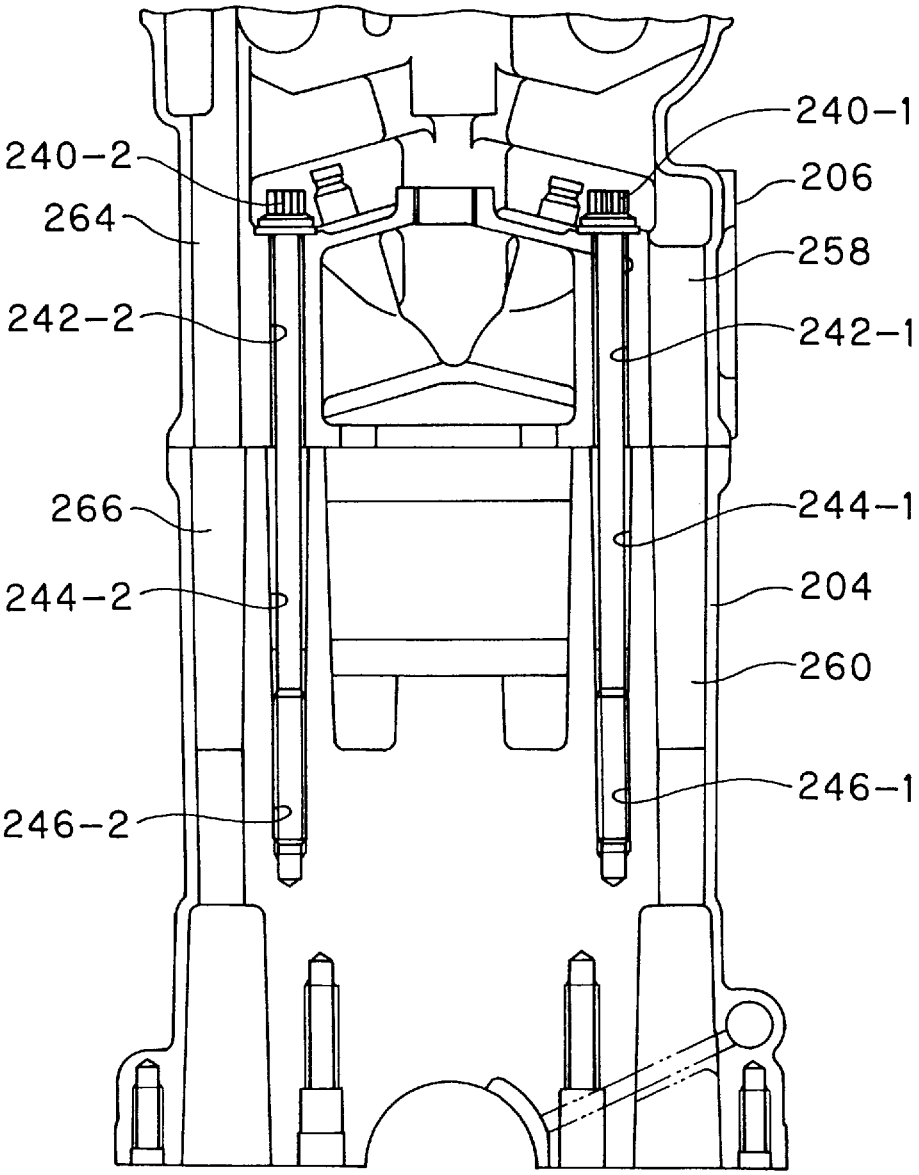
FIG. 16 PRIOR ART
FIG. 16 is a partial cross-sectional view of the engine of FIG. 14.
Figure 17:
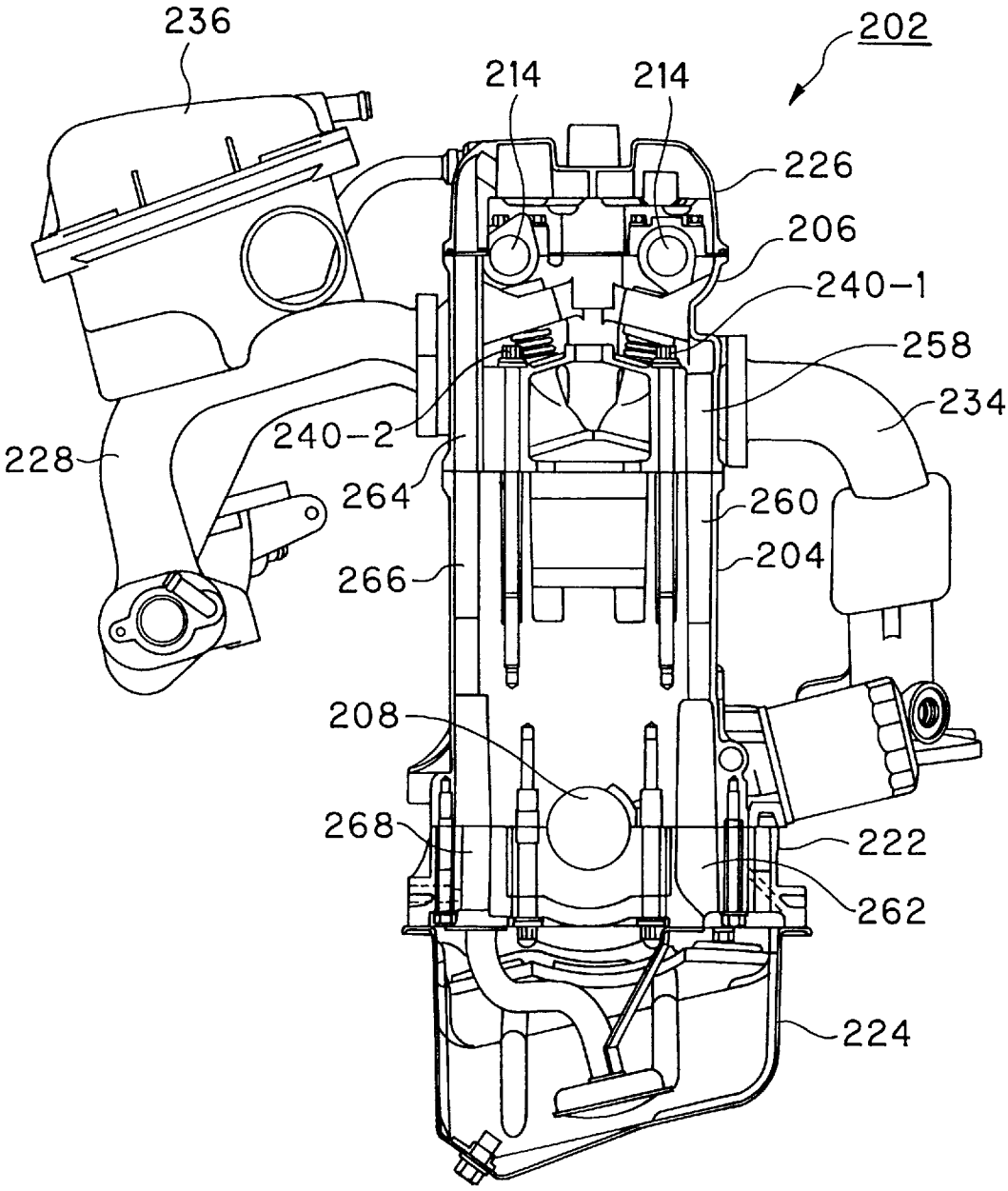
FIG. 17 PRIOR ART
FIG. 17 is a cross-sectional view showing a further conventional engine.
Figure 18:
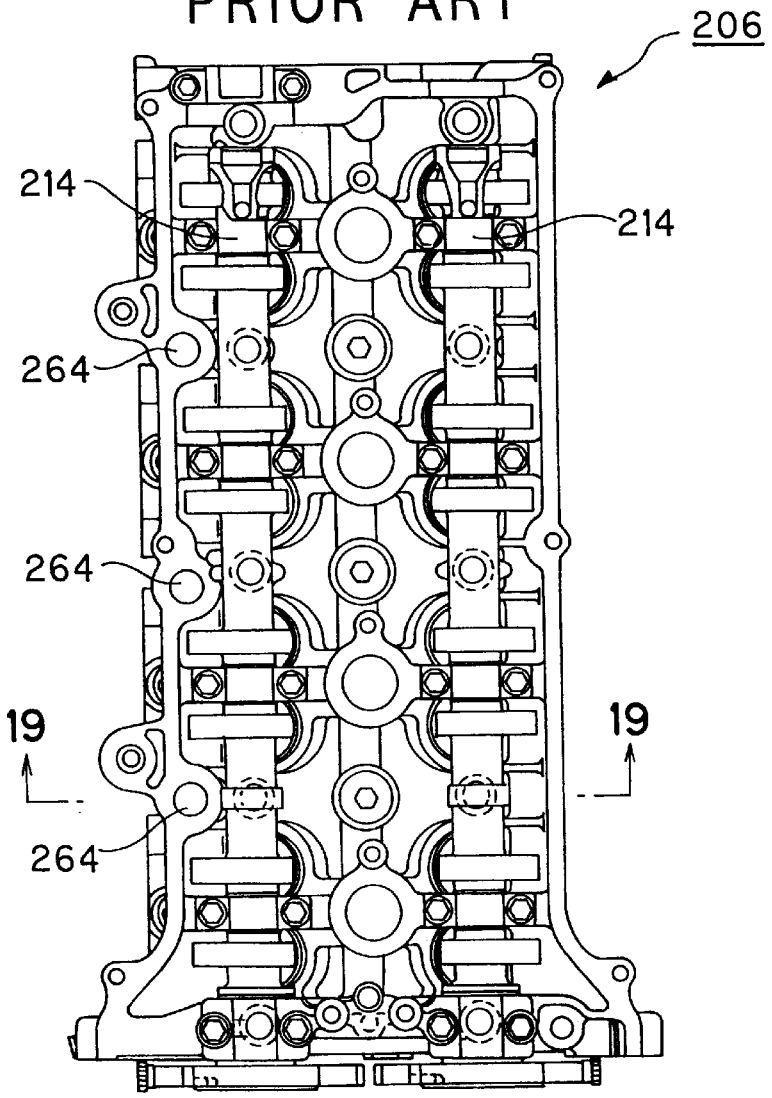
FIG. 18 PRIOR ART
FIG. 18 is a plan view illustrating the cylinder head of the engine of FIG. 17.
Figure 19:
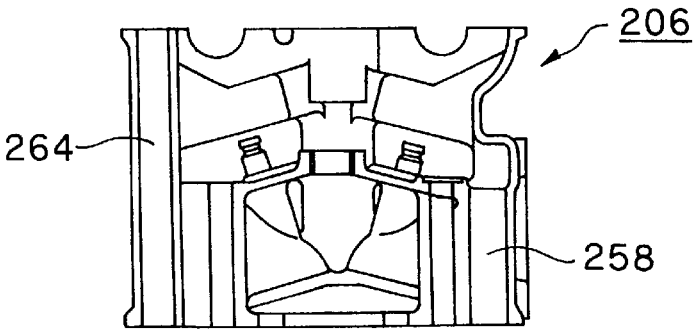
FIG. 19 PRIOR ART
FIG. 19 is a cross-sectional view taken along line 19—19 in FIG. 18 and showing the cylinder head.
Figure 20:
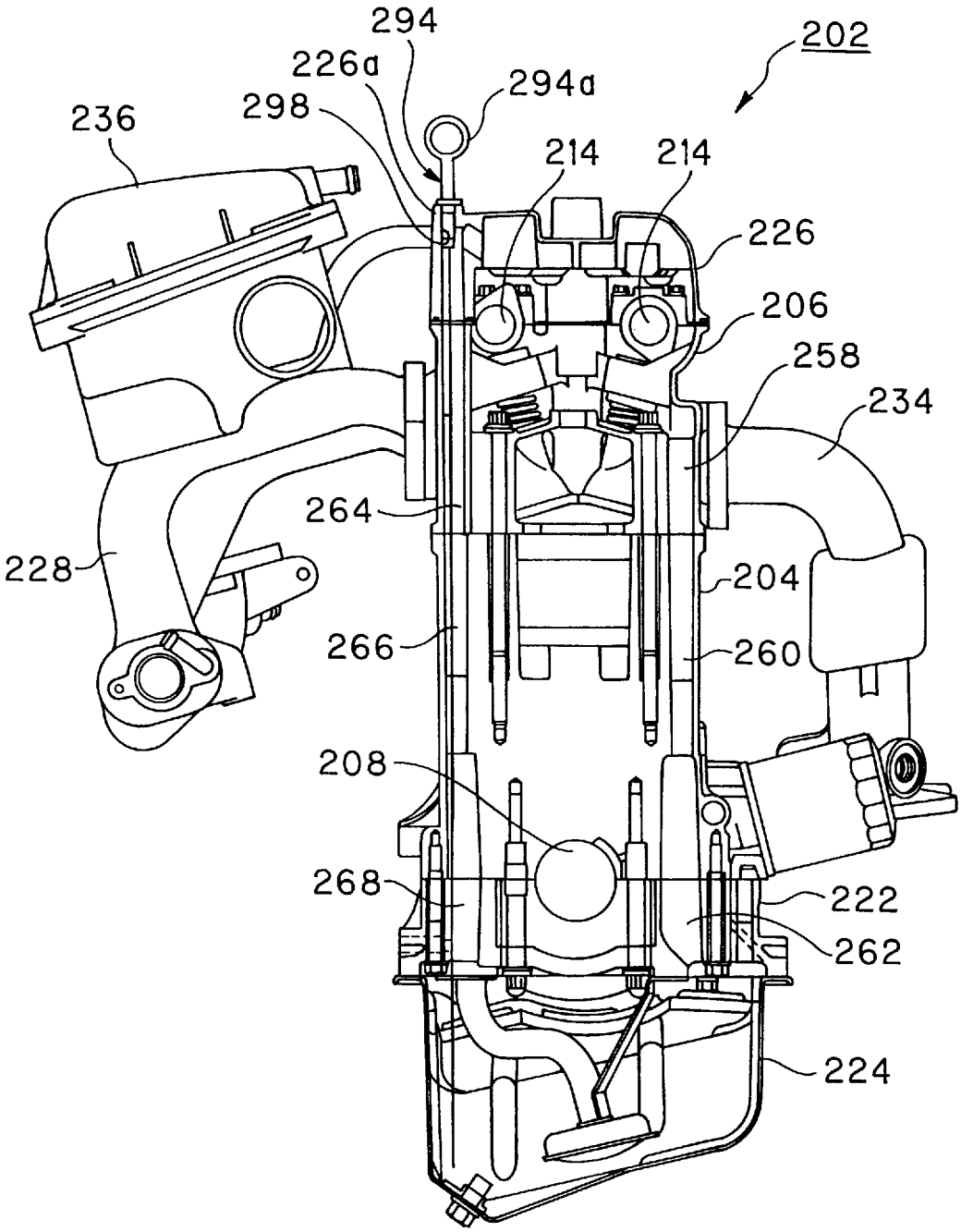
FIG. 20 PRIOR ART
FIG. 20 is a cross-sectional view illustrating the engine of FIG. 17 having an oil level gauge disposed thereon.

Further, as illustrated in FIG. 10, when an oil level gauge 98 is inserted using the second head-side blowby gas passage 68, then the oil level gauge 98 is forcibly bent by the same passage 68 which is offset substantially midway therealong. The oil level gauge 98 is thereby supported at two or more locations, namely at a gauge-mounting opening 26*b* which is formed in a gauge-mounting boss 26*a* of the cylinder head cover 26, and at a connection or shoulder "P" which is formed at the offset. This structure can prevent shaking of handle portion 98*a* of the oil level gauge 98, and thus can prevent oil leakage. Consequently, the oil level gauge 98 is steadily operable.

As evidence by the above description, pursuant to the present invention, the passage-forming object or wall is provided for holding the blowby gas passages in continuous communication with the gas-side breather chamber without an interruption along the blowby gas passages. This structure can realize smooth returning of the blowby gas, and thus can minimize oil degradation. As a result, the lubricating performance of the engine can be enhanced.

In addition, the cylinder block is provided with void space sections which are shared with the cylinder head-mounting bolt holes and the blowby gas passages. This structure is adapted to provide a lightweight cylinder block. The above structure further can prevent the formation of a porous cylinder block when the cylinder block is cast. Further, the molding pin may be made larger in cross section, thereby preventing sand-burning of the molding pin. Yet further, surface pressure between the adjacent cylinder head-mounting bolts can easily be provided so as to evenly distribute the surface pressure on the cylinder head gasket, thereby enhancing the sealing performance of the cylinder head gasket. Still further, the amount of oil in the blowby gas can be reduced to realize a reduction in an oil consumption.

In addition, the blowby gas passages in the cylinder head can be disposed offset at a location partway along the length of the passages. This structure causes the cylinder head to be of a smaller width in the transverse direction thereof, resulting in a compact engine. Further, the above structure forces bending of the oil level gauge, thereby preventing shaking of the handle portion of the oil level gauge. As a result, oil leakage can be prevented, and thus the oil level gauge is reliably operable.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a blowby gas-returning structure for an engine, in which a blowby gas passage is provided in both a cylinder block and a cylinder head so that a blowby gas flowing through between an engine piston and an engine cylinder sleeve is introduced into a gas-side breather chamber, said chamber being formed by a baffle plate within a cylinder head cover, the improvement wherein said cylinder block is provided with a void space section which shares space with a cylinder head-mounting bolt and said blowby gas passage.

2. A blowby gas-returning structure for an engine as defined in claim 1, wherein an internally threaded portion of said cylinder head-mounting bolt hole is provided at a location spaced apart from a deck surface of said cylinder block in order to form said void space section of increased size therebetween.

3. A blowby gas-returning structure for an engine according to claim 1, wherein a partition is joined between said cylinder head cover and said baffle plate whereby said gas-side breather chamber and a fresh air-side breather chamber are defined on opposite sides of said partition, a fresh air-introducing passage communicating with said fresh air-side breather chamber, a return gas discharging passage communicating with said gas-side breather chamber, a breather hole in said baffle plate to provide direct communication from said fresh air-side breather chamber to a head-side end of the blowby passage which extends along one side of the engine cylinder sleeve, and said passage-forming member comprising a wall which extends between a head-end of said cylinder sleeve and said baffle plate so that the blowby passage which extends along the other side of the cylinder sleeve communicates only with said gas-side breather chamber.

4. A blowby gas-returning structure for an engine as defined in claim 1 wherein an elongate bolt connects said cylinder head and said cylinder block, said bolt extending through said void space section, said void space section having a cross-section greater than a cross-section of said bolt to define a portion of said blowby gas passage.

5. A blowby gas-returning structure for an engine as defined in claim 1 wherein said blowby gas passage, said void space section and said cylinder head-mounting bolt hole are disposed on an intake side of the engine, an additional blowby gas passage provided in both the cylinder block and the cylinder head is disposed on an exhaust side of the engine, and an additional void space section is disposed on said exhaust side and shares space with an exhaust side cylinder head-mounting bolt hole and said exhaust side blowby gas passage.

6. A blowby gas-returning structure for an engine as defined in claim 1 wherein said void space section extends downwardly from an upper deck surface of said cylinder block, and an internally threaded portion of said cylinder head mounting bolt hole extends downwardly from an end of said void space section remote from said upper deck surface.

7. A blowby gas-returning structure for an engine as defined in claim 1 wherein a passage forming member is provided in said cylinder head cover to maintain said blowby gas passage in continuous communication with said gas-side breather chamber without such communication being interrupted along said blowby gas passage.

8. A blowby gas-returning structure for an engine comprising:

a cylinder block;

a cylinder head disposed on a mounting face of said cylinder block;

a cylinder head cover disposed on a mounting face of said cylinder head, said cylinder head cover including a baffle plate disposed therein defining a gas-side breather chamber;

said cylinder block and said cylinder head together defining a blowby gas passage for introducing blowby gas flowing between an engine piston and an engine cylinder sleeve into said gas-side breather chamber;

a mounting bolt hole disposed in said cylinder head and a bolt disposed therein for attaching said cylinder head to said cylinder block; and an open region formed in said cylinder block and forming part of said blowby gas passage, said open region opening at said mounting face of said cylinder block and extending transversely therefrom, a portion of said bolt extending through said open region.

9. The blowby gas-returning structure of claim 8 wherein said mounting bolt hole includes an internally threaded portion disposed in said cylinder block and extending transversely from an end of said open region remote from said mounting face of said cylinder block, and a terminal threaded portion of said bolt is threadingly engaged within said threaded portion of said mounting bolt hole.

10. The blowby gas-returning structure of claim 8 wherein said cylinder head has a longitudinal axis generally parallel with a longitudinal axis of an engine crankshaft which divides said cylinder head into an intake side and an exhaust side, said blowby gas passage, said open region and said mounting bolt hole are all disposed at said intake side, said cylinder block and said cylinder head together define an additional blowby gas passage disposed at said exhaust side, said cylinder head includes an additional mounting bolt hole at said exhaust side and a bolt disposed therein for attaching said cylinder head to said cylinder block, said cylinder block includes an additional open region forming part of said exhaust side blowby gas passage, said exhaust side open region opening at said mounting face of said cylinder block and extending transversely therefrom, a portion of said exhaust side bolt extending through said exhaust side open region.

11. The blowby gas-returning structure of claim 10 wherein a wall portion is disposed within said cylinder head cover and adjoins an upper portion of said engine cylinder sleeve and a partition member extends between an inner surface of said cylinder head cover and said baffle plate so as to divide an inside of said cylinder head cover into intake and exhaust sides respectively corresponding to said intake and exhaust sides of said cylinder head, said gas-side breather chamber is defined on said intake side by said wall portion, said baffle plate and one side of said partition member and communicates with said intake side blowby gas passage, a fresh air breather chamber is formed within said cylinder head cover at said exhaust side at an opposite side of said partition member from said gas-side breather chamber, said fresh air breather chamber is defined by said partition member and said baffle plate and communicates with said exhaust side blowby gas passage, said fresh air breather chamber being separate from said gas-side breather chamber to provide uninterrupted flow of blowby gas between said gas-side breather chamber and said intake side blowby gas passage.

* * * * *

UNITED STATES PATENT AND TRADEMARK OFFICE

CERTIFICATE OF CORRECTION

PATENT NO. : 5,850,823
DATED : December 22, 1998
INVENTOR(S) : Satoshi Kasahara

It is certified that error appears in the above-identified patent and that said Letters Patent is hereby corrected as shown below:

Column 10,
Line 24, change "shares space with" to -- shares spaces with --.
Line 25, after "bolt" insert -- hole --.
Line 33, change "claim 1" to -- claim 7 --.

Signed and Sealed this

Second Day of October, 2001

*Attest:*

Nicholas P. Godici

NICHOLAS P. GODICI
*Acting Director of the United States Patent and Trademark Office*

*Attesting Officer*